US010716960B2

(12) United States Patent
Chaumontet et al.

(10) Patent No.: US 10,716,960 B2
(45) Date of Patent: Jul. 21, 2020

(54) BELAY DESCENDER DEVICE ON A ROPE WITH GEARING-DOWN AND ANTI-PANIC BLOCKING

(71) Applicant: ZEDEL, Crolles (FR)

(72) Inventors: Michael Chaumontet, Crolles (FR); Julien Moine, La Terrasse (FR); Christophe Quillard, Eybens (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 15/003,886

(22) Filed: Jan. 22, 2016

(65) Prior Publication Data

US 2016/0228730 A1 Aug. 11, 2016

(30) Foreign Application Priority Data

Feb. 11, 2015 (FR) ..... 15 51093

(51) Int. Cl.
*A62B 1/14* (2006.01)
*A63B 29/02* (2006.01)

(52) U.S. Cl.
CPC ..... *A62B 1/14* (2013.01); *A63B 29/02* (2013.01)

(58) Field of Classification Search
CPC .... A62B 1/00; A62B 1/06; A62B 1/20; A62B 1/14; A63B 29/02
See application file for complete search history.

(56) References Cited

U.S. PATENT DOCUMENTS

| | | | | |
|---|---|---|---|---|
| 5,577,576 | A * | 11/1996 | Petzl | A62B 1/14 182/193 |
| 6,029,777 | A * | 2/2000 | Rogelja | A62B 1/14 182/192 |
| 2007/0215411 | A1* | 9/2007 | Petzl | A62B 1/14 182/193 |
| 2009/0026023 | A1 | 1/2009 | Petzl et al. | |
| 2011/0073417 | A1 | 3/2011 | Chaumontet et al. | |
| 2013/0032433 | A1* | 2/2013 | Codega | A62B 1/14 182/5 |
| 2014/0138191 | A1* | 5/2014 | Chabod | A62B 1/06 188/65.1 |

(Continued)

FOREIGN PATENT DOCUMENTS

| | | |
|---|---|---|
| EP | 2 018 894 A1 | 1/2009 |
| EP | 2 301 631 A1 | 3/2011 |
| EP | 2 554 219 A1 | 2/2013 |

(Continued)

*Primary Examiner* — Catherine A Kelly
*Assistant Examiner* — Shiref M Mekhaeil
(74) *Attorney, Agent, or Firm* — Oliff PLC

(57) ABSTRACT

A belay descender device for a rope comprising a cam mounted rotating on a fixed flange to perform locking of the rope when said rope is under tension, and a lever articulated on the cam to perform progressive unlocking of the rope with a geared-down effect at the beginning of unlocking travel of the lever. The operating lever comprises transmission means collaborating with a guide ramp of the flange to interrupt the mechanical link with the cam after an intermediate position of the lever has been passed resulting in freeing from said ramp outside the gearing-down area. The end of the guide ramp of the flange corresponds to the anti-panic position of the transmission means, enabling automatic locking of the cam as soon as the gearing-down area has been passed.

14 Claims, 13 Drawing Sheets

(56) References Cited

U.S. PATENT DOCUMENTS

| | | | | |
|---|---|---|---|---|
| 2014/0196984 | A1* | 7/2014 | Chabod | A62B 1/14<br>182/18 |
| 2016/0287913 | A1* | 10/2016 | Bell | A62B 1/14 |

FOREIGN PATENT DOCUMENTS

| | | | |
|---|---|---|---|
| EP | 2 777 772 | A2 | 9/2014 |
| WO | 03/092816 | A1 | 11/2003 |

* cited by examiner

BELAY DESCENDER DEVICE ON A ROPE WITH GEARING-DOWN AND ANTI-PANIC BLOCKING

BACKGROUND OF THE INVENTION

The invention relates to a belay descender device for a rope comprising:

- a cam mounted rotating on a fixed flange to perform locking of the rope when said rope is under tension,
- an operating lever or handle articulated on the cam to cause progressive unlocking of the rope with a geared-down effect at the beginning of the unlocking travel of the lever.

STATE OF THE ART

FIG. 1 represents a self-locking delay device for a rope described in detail in the document EP 2301631. It comprises a pulley in the form of a cam 10 arranged to cause locking of the rope when the rope is under tension, and an operating lever 11 collaborating with the cam 10 in order to cause progressive unlocking of the rope following a manual action on the lever 11 in the direction of the arrow F. The lever 11 acts on the cam 10 respectively with a geared-down effect in an initial part of its unlocking travel and with a direct driving effect in a final part of its travel. The relative movement of the cam 10 with respect to the movement of the lever 11 is lower in the initial part of travel than in the final part, which enables a precise adjustment of the braking force and of the running speed, of the rope in the initial part of the travel of the lever 11. The cam 10 is articulated on a pivot-pin 12 of a fixed flange 13 and the operating lever 11 is articulated by a pivot-pin 14 on the cam 10. The lever 11 comprises a bearing pin 15 designed to come into contact against a stop 16 of the flange 13, said stop being located between the respective pivot-pins 12, 14 of the cam 10 and lever 11 when the latter is made to rotate in the unlocking direction. From this position, if the user pulls on the lever 11 in the clockwise unlocking direction, the cam 10 is urged in the clockwise direction with a geared-down force. With a low energy expenditure, the user can exert a large force on the cam 10 to overcome the force necessary to unlock the rope, and then to finely adjust the position of the cam 10 to modulate the clamping of the rope thereby finely adjusting the running speed of the rope.

FIG. 1 represents the descender in a released position obtained when the user continues to pull on the lever 11 in the clockwise direction. The pin 15 disengages from the stop 16 and comes and presses on a wall of the cam 10. The lever 11 is in a configuration without gearing-down of the driving, causing a direct and rapid movement of the cam 10 to the unlocking end-of-travel position. The cam 10 no longer blocks the rope so long as the lever 11 is kept in this position by the user. It can be noted that the pin 15 of the lever 11 remains pressing on the cam 10 establishing a permanent mechanical link between the cam 10 and the lever 11. If the user panics during an uncontrolled descent along the rope, he is liable to grip the lever 11 pulling it strongly downwards. The rope is free and the user will not be able to stop to the detriment of his safety.

The anti-panic function is known as such on conventional self-braking descenders as illustrated in the documents EP 2,777,772 and EP 2,018,894, but not on a belay descender device with gearing-down for unlocking of the cam.

OBJECT OF INVENTION

The object of the invention consists in providing a belay descender device on a rope that is able to be easily unlocked manually to improve the fluidity of descent along the rope, and that benefits from an automatic re-locking function in the event of the user panicking.

The apparatus according to the invention is characterized in that the operating lever comprises transmission means collaborating with a guide ramp of the flange to interrupt the mechanical link with the cam after an intermediate position of the lever has been passed, resulting in freeing from said ramp outside the gearing-down area, and the end of the guide ramp of the flange corresponds to the anti-panic position of the transmission means enabling automatic locking of the cam as soon as the gearing-down area has been passed.

According to a first embodiment of the invention, the transmission means comprise a drive rod articulated on the lever and able to slide along the guide ramp in said gearing-down area for unlocking the cam.

According to a second embodiment, the transmission means are provided with a drive pivot-pin securedly attached to the lever and collaborating with a ratchet pivotally mounted on a pivot-pin of the flange, said ratchet being pushed by the drive pivot-pin against the guide ramp during the gearing-down area to trigger driving of the cam in the unlocking direction. The pivot-pin is configured to come free from the ratchet in the intermediate anti-panic position.

Preferentially, an overtravel of the lever in the unlocking direction beyond the intermediate position re-establishes the mechanical link with the cam and drives the latter directly without gearing-down.

Resetting of the anti-panic function is performed manually by moving the operating lever in the opposite direction to place the transmission means back in their original position on the side of the guide ramp.

BRIEF DESCRIPTION OF THE DRAWINGS

Other advantages and features will become more clearly apparent from the following description of two embodiments of the invention given for non-restrictive example purposes only and represented in the appended drawings, in which.

DETAILED DESCRIPTION OF THE INVENTION

Figure 1:
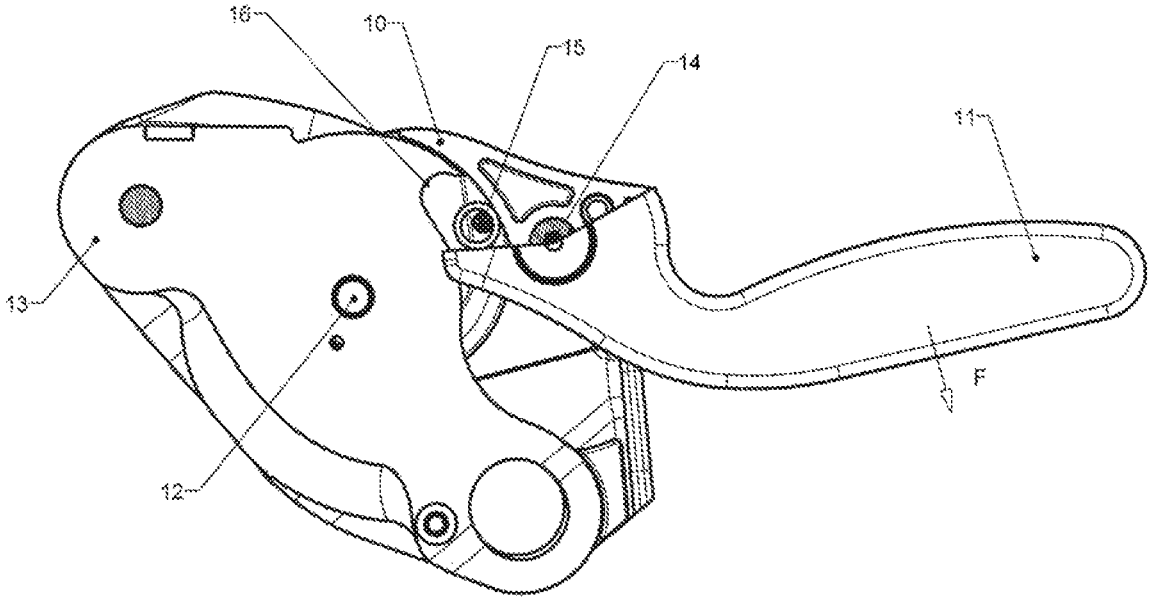
FIG 1 (Prior Art)
FIG. 1 is an elevational view of a belay descender apparatus with an unlocking lever according to the prior art.
Figure 2:
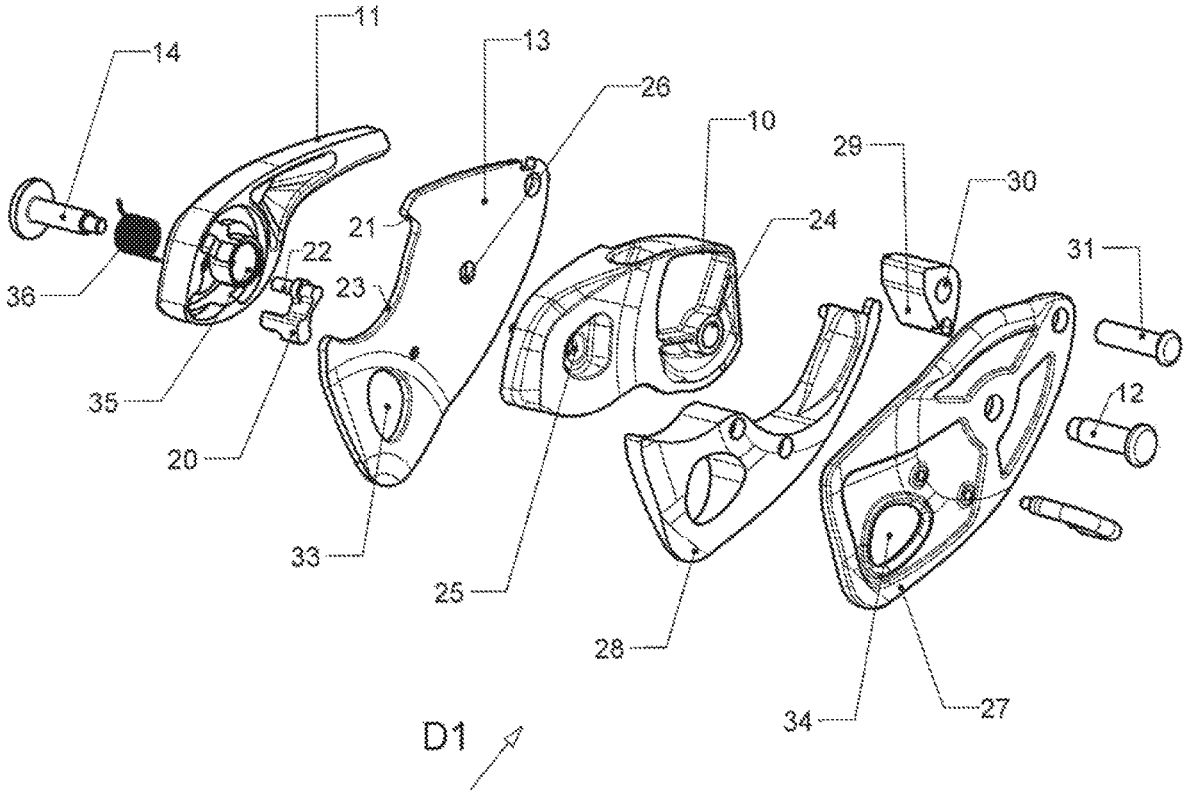
FIG. 2 shows an exploded perspective view of a first embodiment of the belay descender according to the invention.

With reference to FIG. 2 illustrating an exploded perspective view of a first belay descender D1 according to the invention, the fixed flange 13 for fitting the rotary cam 10 and the operating lever 11 in the form of a handle articulated on the cam 10 by the pivot-pin 14 can be seen. The cam 10 and operating lever 11 are arranged on each side of the flange 13. The bearing pin 15 of the device of FIG. 1 of the prior art is replaced by a drive rod 20, and the direct stop 16 is not provided and is replaced by a guide ramp 21 located along the edge of the flange 13. The rod 20 is articulated on the lever 11 by means of a pivot-pin 22, and is kept in position by a spring (not shown). The flange 13 is provided with a recess 23 allowing passage of the rod 20 when if moves along the guide ramp 21 after actuation of the lever 11 in the unlocking direction. The recess 23 is delineated at its top part by the guide ramp 21. The cam 10 comprises a first aperture 24 for passage of the pivot-pin 12 fixed in a hole 26 of the flange 13, and a second aperture 25 for fixing the pivot-pin 14 of the operating lever 11. A second flange 27 is arranged opposite the first flange 13 and collaborates with a spacer 28 to keep the rope in place. The second flange 21 can be fixed or rocking. For unlocking the rope, the cam 10 presses the rope against a braking surface 29, which is provided on a stud 30 inserted and secured by a screw 31 between the two flanges 13, 27. The two flanges 13, 27 are provided with holes 33, 34 for hooking an attachment (not shown).

Figure 3:
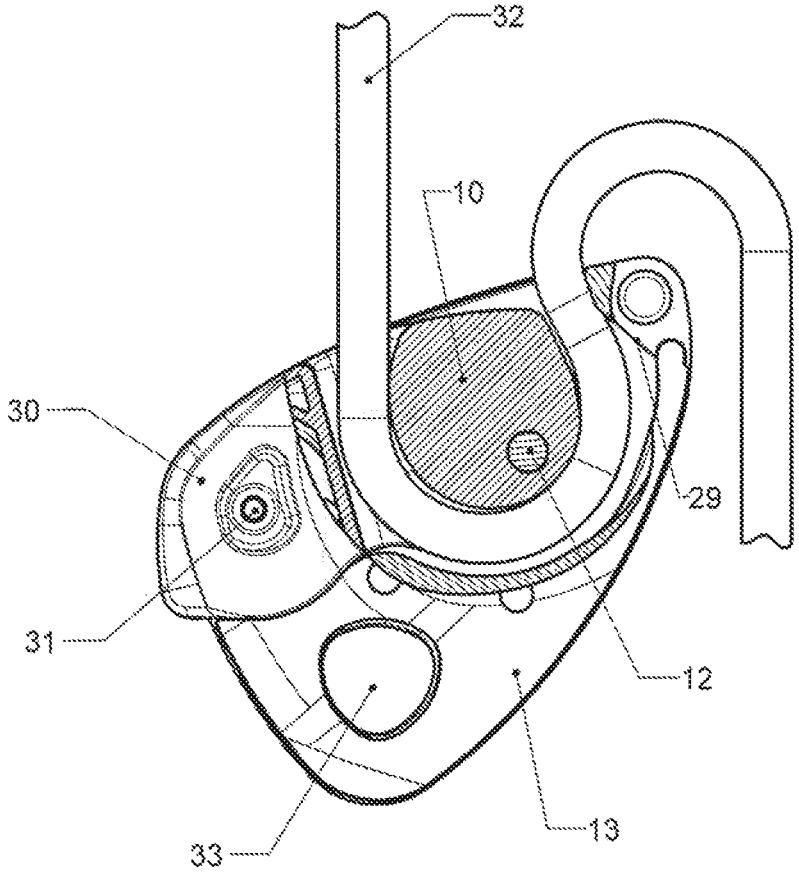
FIG. 3 is a cross-sectional view of the belay descender on the cam side, and after the rope has been fitted.

FIG. 3 shows the descender on the side of the cam 10, after a rope 32 has been fitted. The cam 10 is mounted eccentric on the pivot-pin 12 and is in the form of a pulley around which a loop of the rope 32 is wound.

Figure 4A:
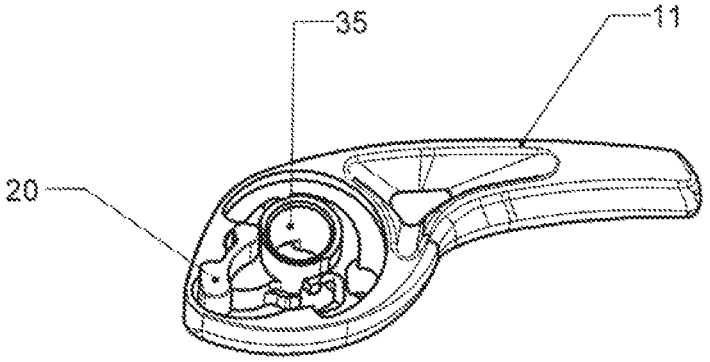
FIGS. 4A and 4B are perspective views of the operating lever 11 equipped with a drive rod illustrated in two different positions.
Figure 4B:
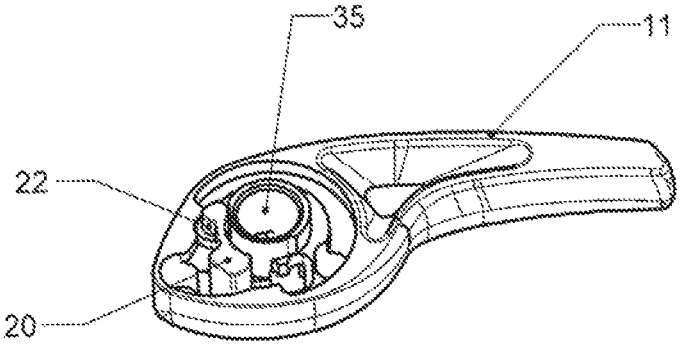
Figure 4C:
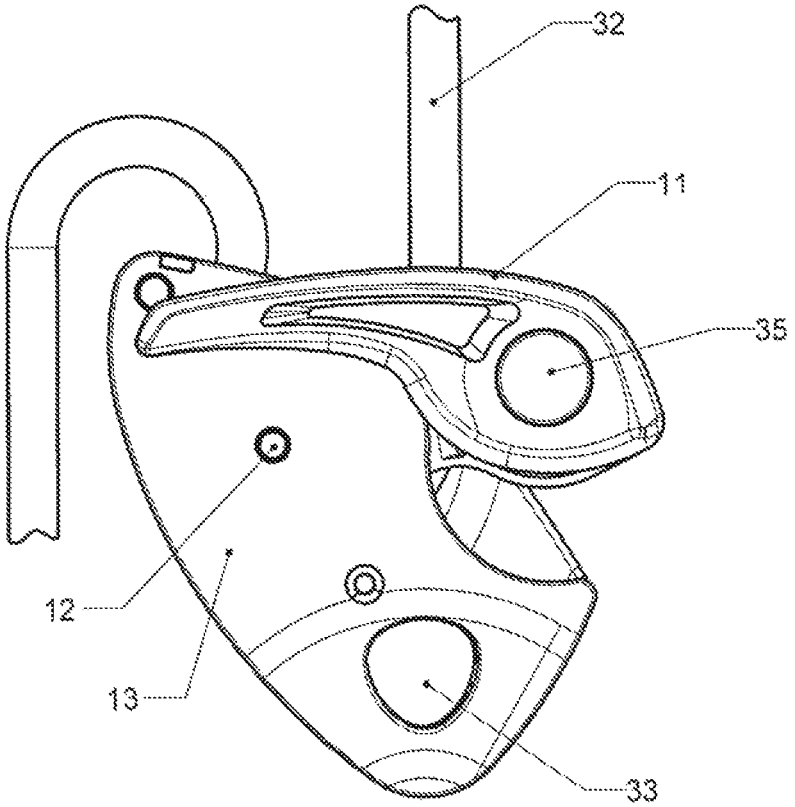
FIG. 4C shows the apparatus in the looked state following tension of the rope, the lever occupying a folded position near the flange.

FIGS. 4A and 4B represent the operating lever 11 equipped with the drive rod 20, which can pivot around its pivot-pin 22. The latter is threaded into a blind hole of the lever 11, near the circular aperture 35 through which the pivot pin 14 of the lever 11 passes. A torsion spring 36 (FIG. 2) is threaded coaxially on the pivot-pin 14 inside the aperture 35 to bias the cam 10 to the unlocking position.

Operation of the descender belay according to the invention is illustrated with reference to FIGS. 4C and 5-12.

When the rope 32 is under tension, either due to the user's weight when used as a descender, or when used for belaying by the traction effect exerted by a lead climber to be belayed, the cam 10 is urged in rotation around the pivot-pin 12 to the locked position. The rope 32 is jammed by cam 10 against the braking surface 29 so as to stop any downward movement of the user. The operating lever 11 is folded completely to the left, near the fixed flange 13 (see FIG. 4C).

Figure 5:
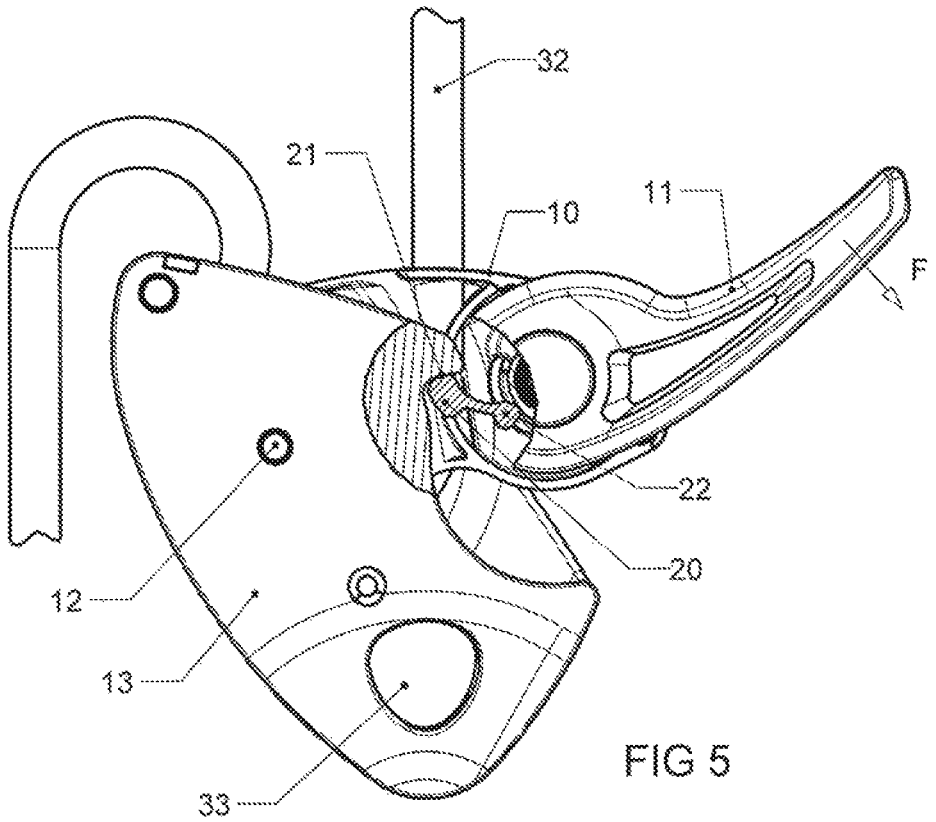
FIGS. 5 and 6 represent partial cross-sectional views of the lever when progressive unlocking of the cam is performed with a geared-down force.

To release this locked position when the rope 32 is under tension, the user unfolds the lever 11 by rotating it in the clockwise direction. In FIG. 5, the rod 20 presses on the ramp 21 which defines the gearing-down area for driving the cam 10 in the unlocking direction with a geared-down force. Rotation of the lever 11 results in rotation of the cam 10 in a predefined ratio, for example 1/3.

Figure 6:
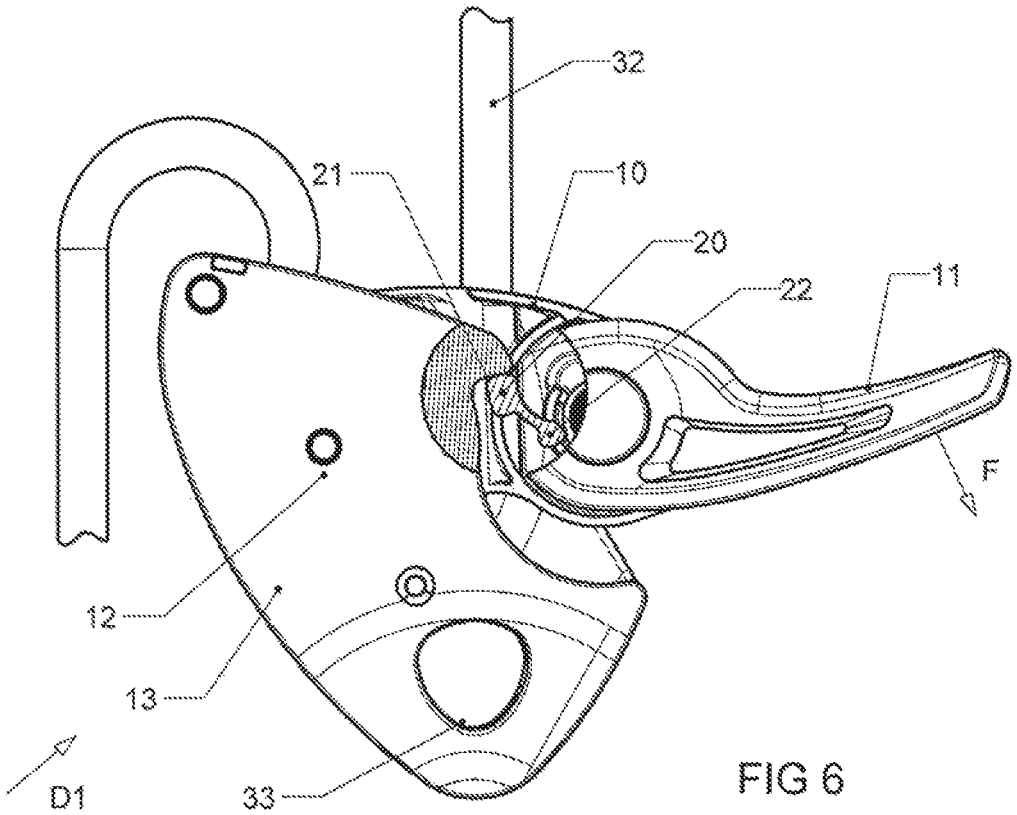

In FIG. 6, continued movement of the lever 11 in the direction of the arrow F drives the rod 20 which will slide along the guide ramp 21. So long as the rod 20 remains on the ramp 21, the user will be able to adjust the degree of jamming of the rope and control the speed of descent in descender mode.

Figure 7:
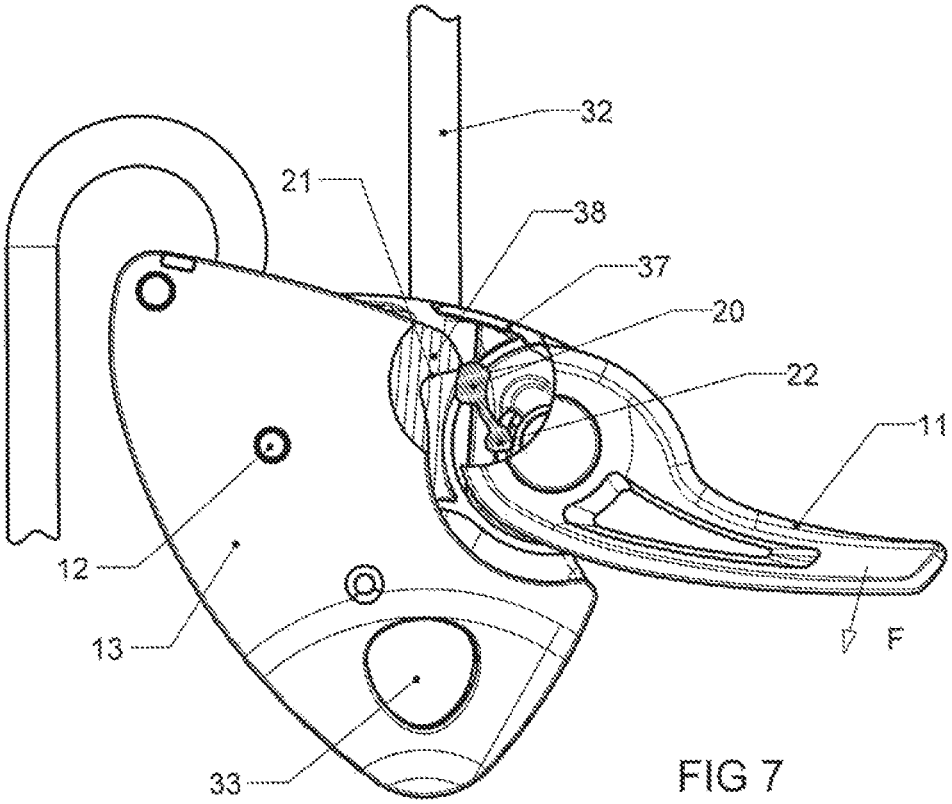
FIG. 7 illustrates freeing of the rod with interruption of the mechanical link between the lever and the cam, causing automatic relocking of the apparatus.

In FIG. 7, if the rod 20 reaches and passes the end of the ramp 21, it is ready to come free from the flange 13 so as to interrupt the mechanical transmission link between the lever 11 and cam 10. The latter, being released, will be automatically returned to the unlocking position of the rope by the biasing action of the torsion spring 36. This case can occur when the user pulls very strongly on the lever 11 in the unlocking direction, >t is the anti-panic function which automatically relocks the rope 32, beyond the gearing-down area after the rod 20 has come free from the ramp 21.

Figure 8:
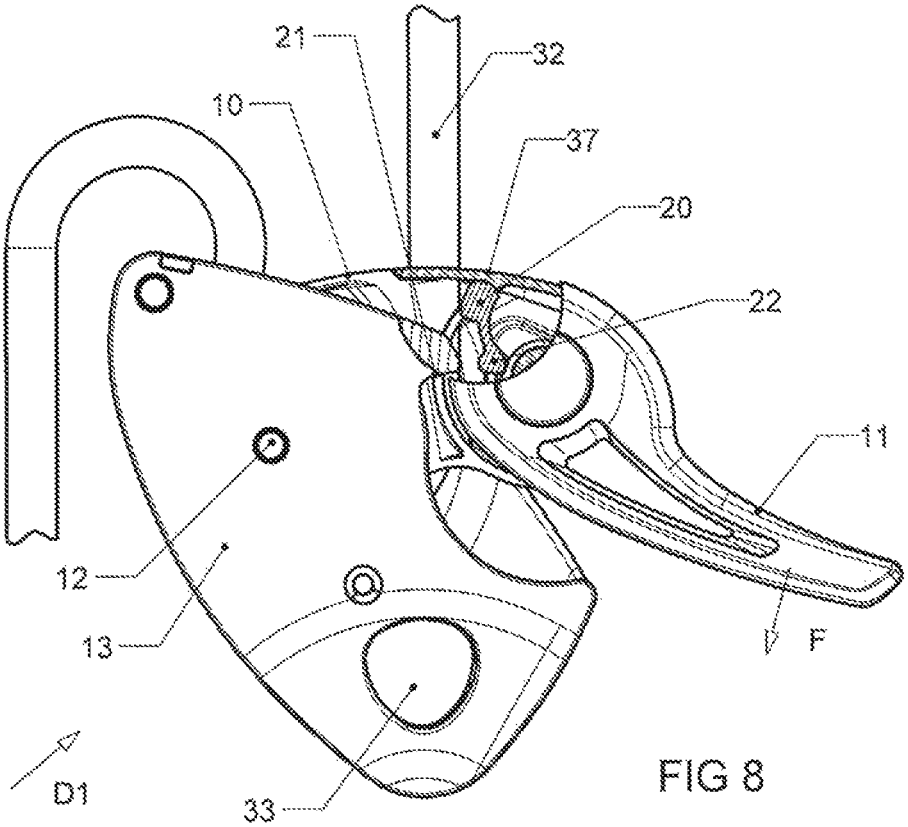
FIG. 8 represents an overtravel of the unlocking lever to re-establish the mechanical link with the cam enabling the user to be able to unlock the cam manually without gearing-down.
Figure 9:
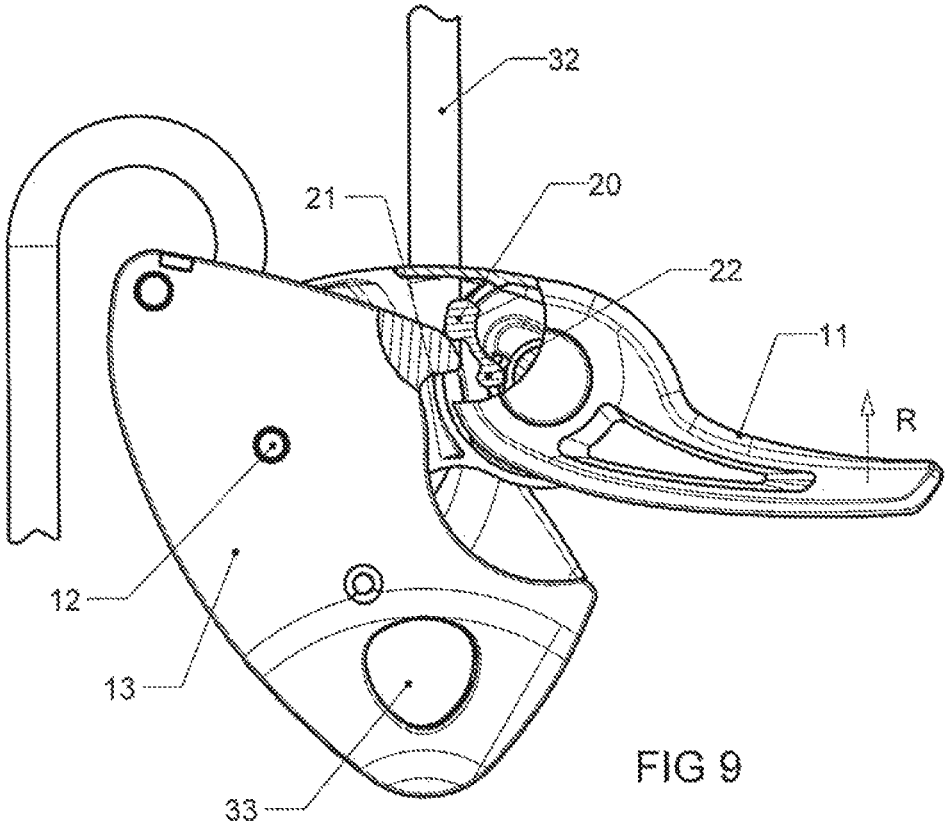
FIGS. 9 to 12 show the successive phases of manual reloading of the lever to reactivate the anti-panic function after the rod has come free.

In FIG. 8, after an overtravel of the lever 11 in the direction of the arrow F, the rod 20 comes into engagement against a stop 37 of the cam 10, which re-establishes the mechanical link enabling the user to be able to unlock the cam 10 and to descend without gearing-down, if he does not know how to reset the mechanism, and to reactivate the anti-panic function.

FIGS. 9 to 12 represent the different phases of manual resetting to reactivate the anti-panic function after the rod 20 has come free.

Figure 10:
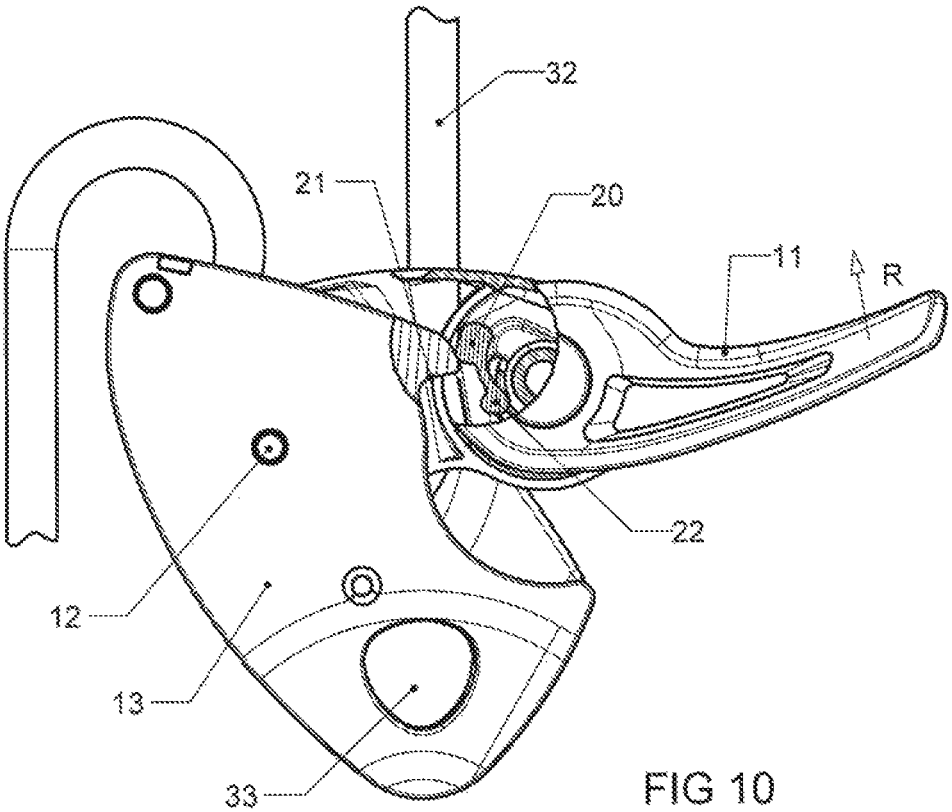

The lever 11 simply has to be moved in the counterclockwise direction indicated by the arrow R (FIG. 9), resulting in pivoting of the rod 20 around its pivot-pin 22 when it is pressing on the flange 13 (FIG. 10).

Figure 11:
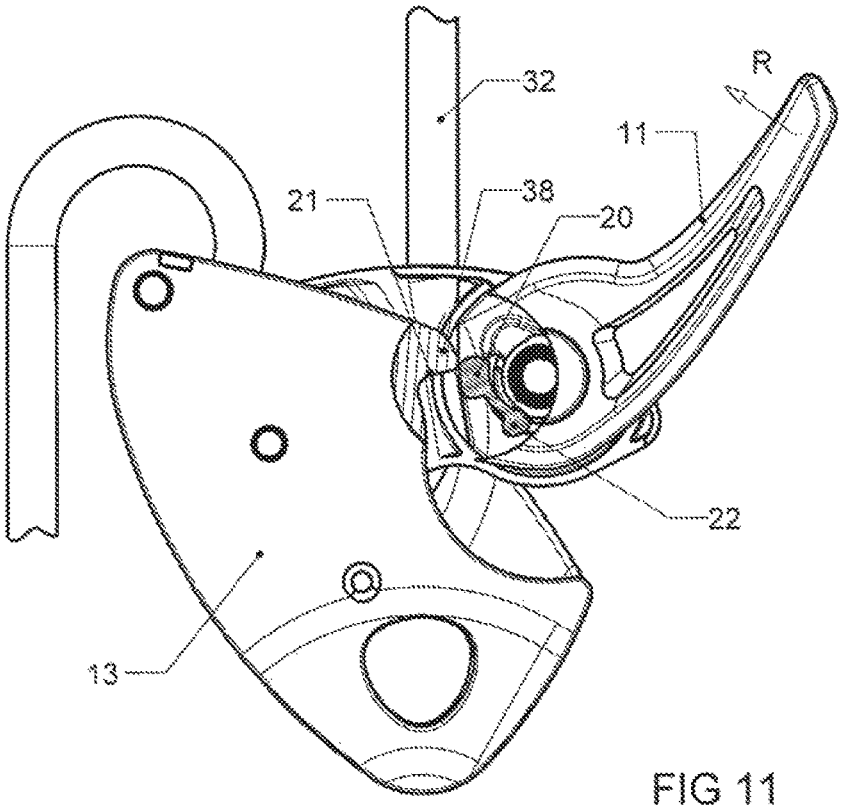
Figure 12:
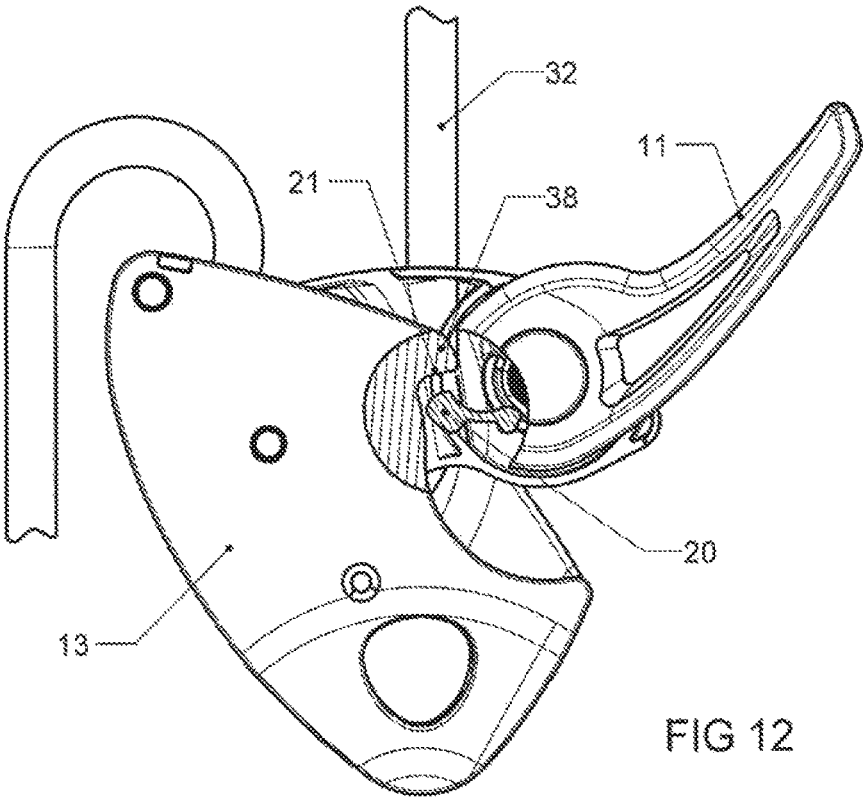
Figure 13:
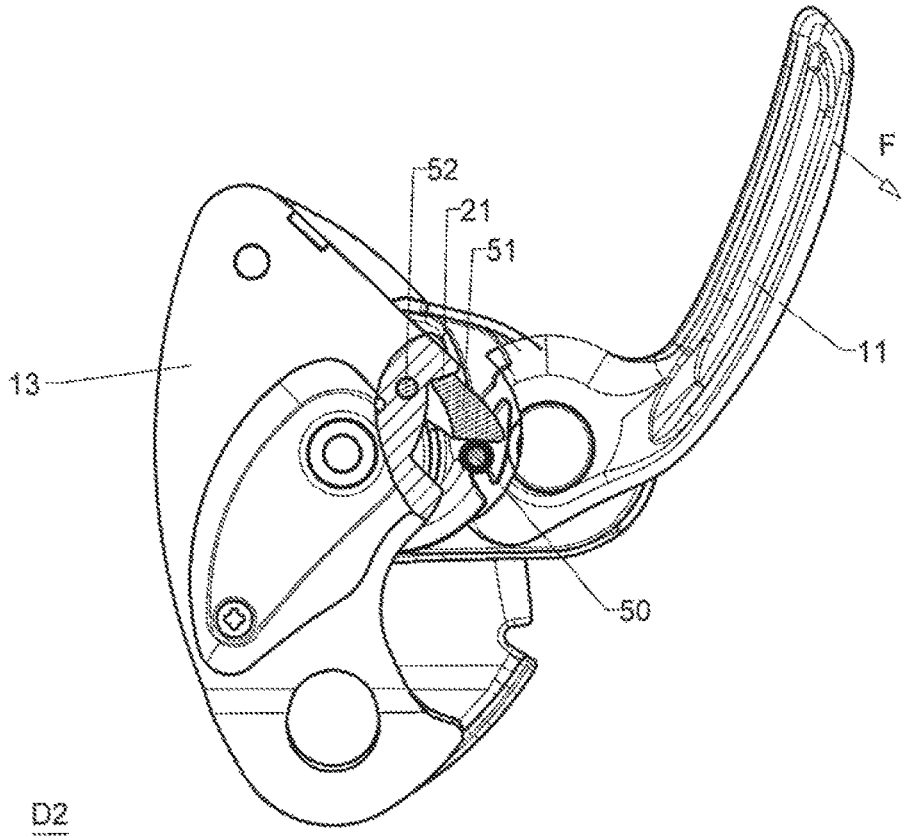
FIGS. 13 to 16 show cross-sectional views of a second embodiment of the invention, which is illustrated in the course of the geared-down unlocking cycle up to the anti-panic position.
Figure 14:
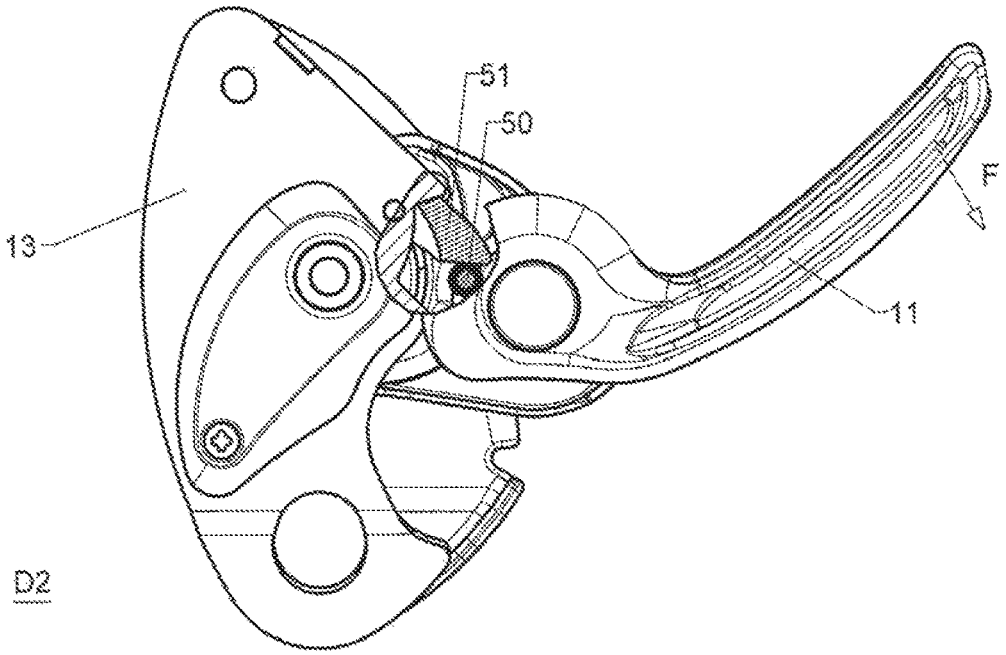

In FIG. 11, the rod 20 retracts passing over the nose 38 of the flange 13 and comes back to place itself in the original position inside the ramp 21 of the flange 13 due to the presence of a spiral spring (see FIG. 12).

FIGS. 13 to 19 show a second embodiment of a belay descender D2 according to the invention. Most of the pasts are identical with the same reference numerals, only the means for implementing the anti-panic function are different compared with those of the above-mentioned device D1.

The rod 20 of the device D1 of FIGS. 2-12 is replaced by a drive spindle 50 securedly attached to the lever 11, said spindle being designed to collaborate with a ratchet 51 mounted pivoting on a pivot-pin 52 of the flange 13. The ratchet 51 is preferably mad(c) from stainless steel enabling a contact with the pivot-pin 50 with a high endurance.

At the beginning of the clockwise travel of the lever 11 (arrow F, FIGS. 13 and 14), the pivot-pin 50 pushes the ratchet 51 up against the ramp 21 of the flange 13 to trigger driving of the cam 10 in the unlocking direction. The pivot-pin pin 50 is advantageously surrounded by a tube, for example made from stainless steel, to improve sliding of the pivot-pin 50 on the ratchet 51. The force take-up area between the ratchet 51 and the ramp 21 of the flange 13 enables a geared-down unlocking of the cam 10 when the descender D2 is under load.

Figure 15:
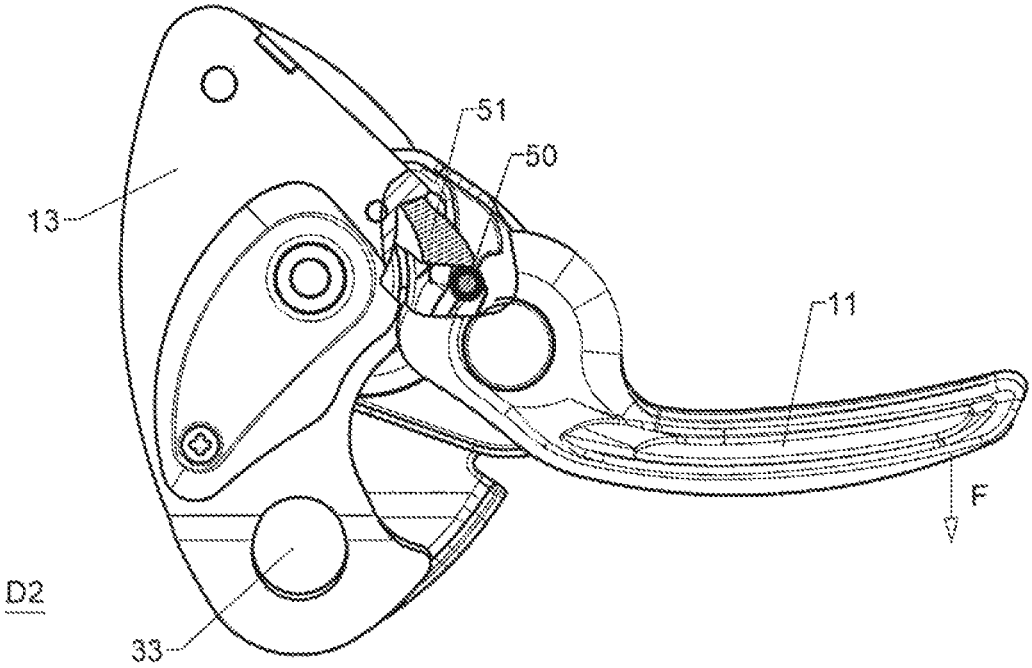
Figure 16:
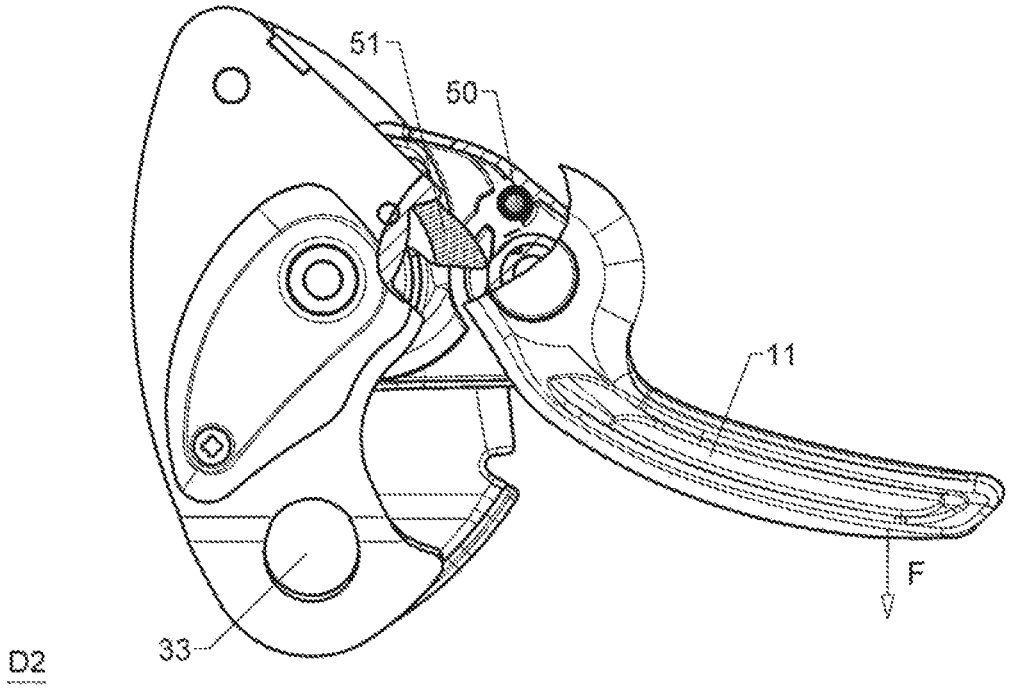
Figure 18:
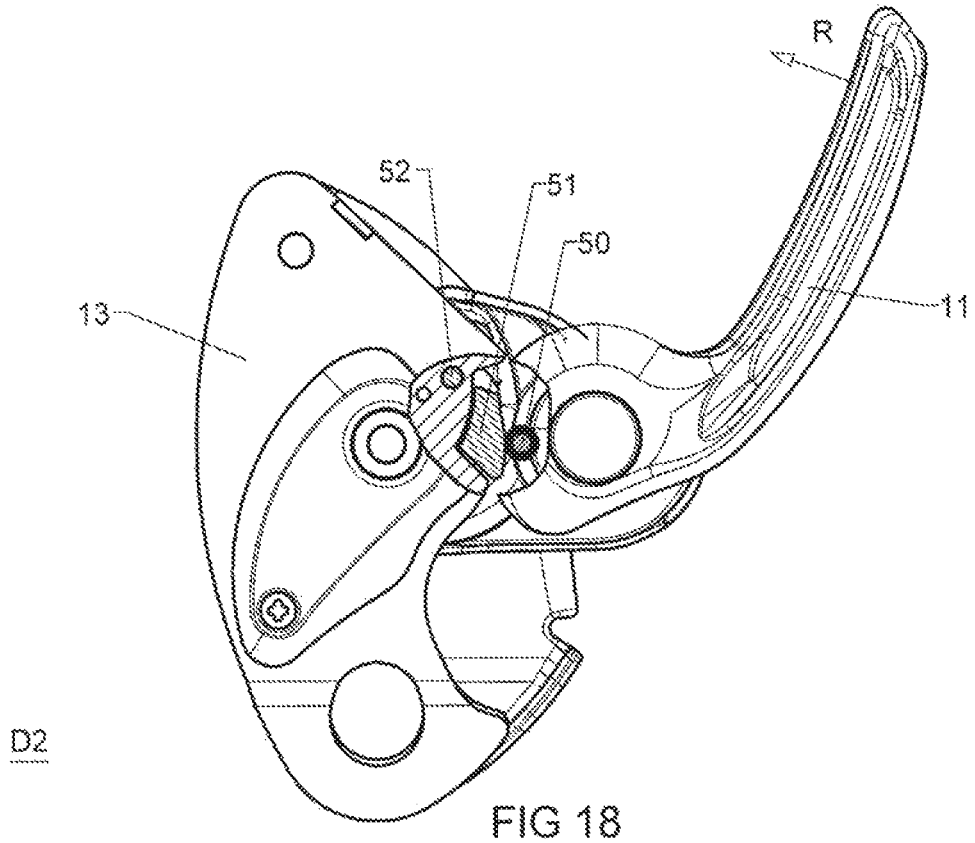
Figure 19:
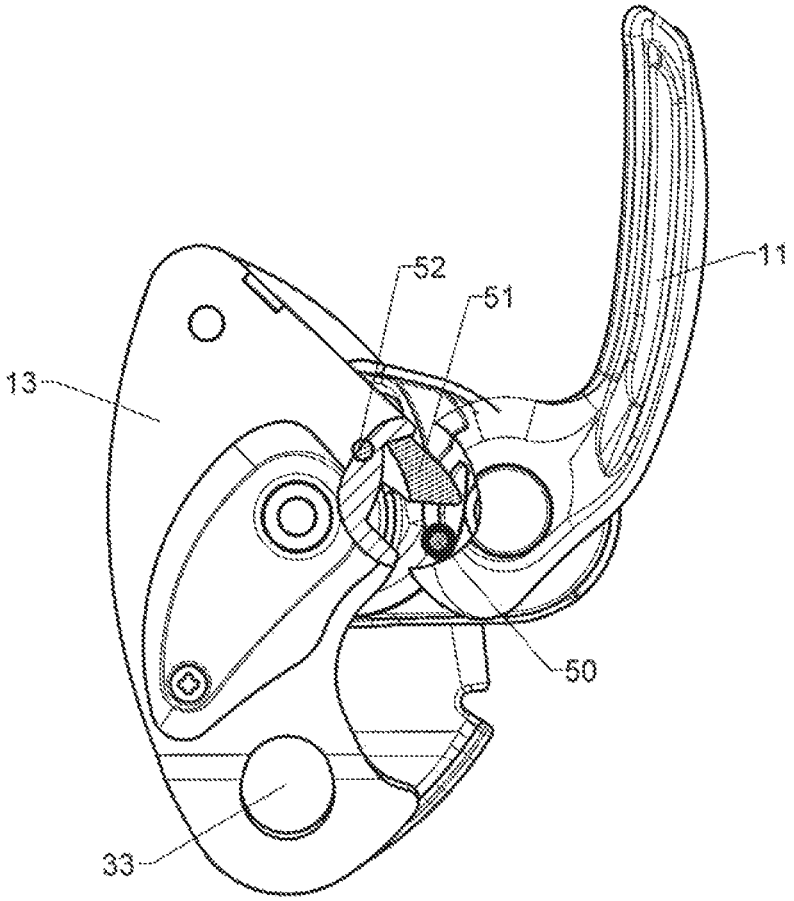

In FIG. 15, continued movement of the lever 11 in the direction of the arrow F positions the pivot-pin 50 at the right-hand end of the ratchet 51, ready to come free to interrupt the mechanical link between the lever 11 and cam 10. This is the anti-panic position in which the released cam 10 automatically blocks the rope 32 following freeing of the pivot-pin 50 (FIG. 18). If the user continues rotation of the lever 11 in the direction F, the pivot-pin 50 comes up against the stop formed by the cam 10 and drives the latter directly without gearing-down. This operation enables slack to be given when a user is to be descended in top-rope manner in the absence of tension on the rope.

Figure 17:
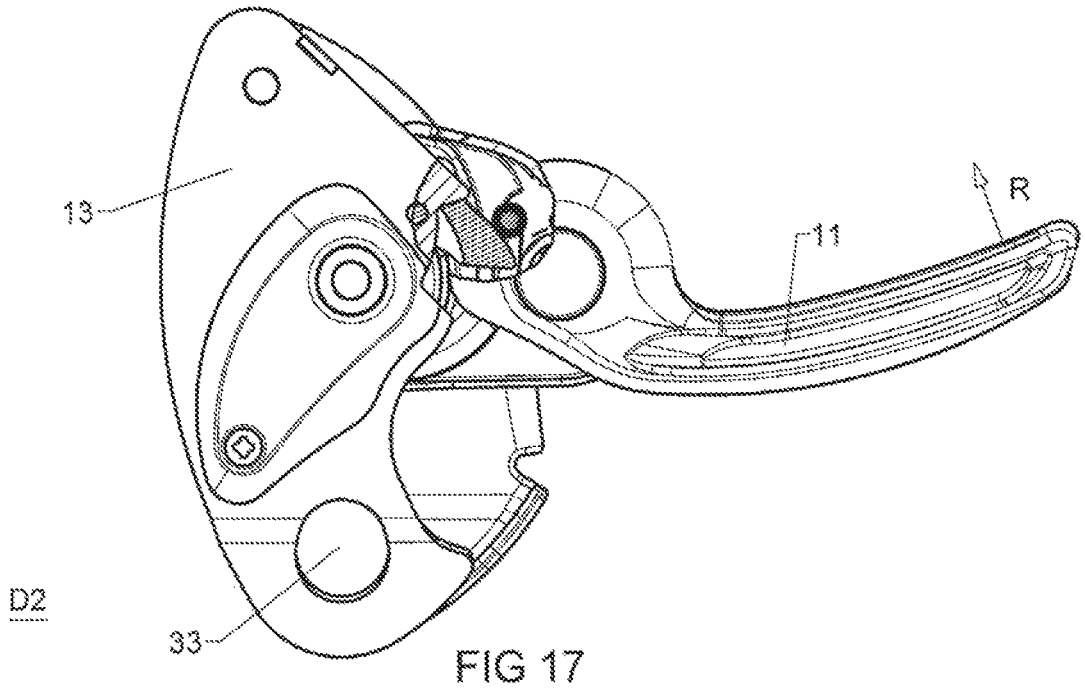
FIGS. 17 to 19 show the different phases of manual resetting of the anti-panic function of the second embodiment.

Resetting of the anti-panic function is performed by moving the lever 11 in the opposite direction to replace the drive pivot-pin 50 in its original position by means of the spring-loaded ratchet 51. For this the lever 11 simply has to be moved in the counterclockwise direction of arrow R. At the beginning of resetting, the reaction of the pivot-pin 50 on the curved surface of the ratchet 51 causes withdrawal thereof (FIGS. 17 and 18). The drive pivot-pin 50 of the lever 11 can thus return to its original position (FIG. 19), with the anti-panic reset.

The invention claimed is:

1. A belay descender device for a rope comprising:

a fixed flange defining a guide ramp;

a cam mounted rotating around a first pivot-pin fixed on the fixed flange, the cam moving between a first position and a second position, the first position locking the rope when said rope is under tension;

an operating lever mounted on the cam and mounted movable with respect to the cam and to the fixed flange, the operating lever being moveable in first and second opposite directions; and a drive rod fixed to the operating lever and arranged to slide along the guide ramp of the fixed flange so that a rotation of the operating lever in the first direction causes sliding of the drive rod along the guide ramp and causes movement of the cam from the first position to the second position with respect to the fixed flange, wherein when the operating lever reaches a threshold position in a movement along the first direction, the drive rod loses mechanical contact with the fixed flange and the cam moves to the first position, wherein the guide ramp defines a gear-down effect between the cam and the operating lever when the operating lever moves to the threshold position in the first direction, and wherein the drive rod is in direct contact with the cam beyond the threshold position.

2. The belay descender device according to claim 1, wherein the drive rod is mounted movable with respect to the operating lever so as to move with respect to the operating lever only when the operating lever moves along the second direction.

3. The belay descender device according to claim 1, wherein after reaching the threshold position in a movement of the operating lever in the first direction, a movement of the operating lever in the second direction causes a movement of the drive rod so that the drive rod pushes onto the guide ramp causing rotation of the drive rod with respect to the operating lever.

4. The belay descender device according to claim 3, wherein the drive rod is directly fixed to the operating lever and wherein the movement of the operating lever in the second direction causes rotation of the drive rod with respect to the operating lever in a direction perpendicular to an axis of rotation of the operating lever until the drive rod contacts the guide ramp.

5. The belay descender device according to claim 1, wherein the operating lever is mounted rotating around a second pivot-pin fixed to the cam, the second pivot-pin defines an axis of rotation for the operating lever, the operating lever and the cam are separated by the fixed flange and the second pivot-pin facing the guide ramp in a direction orthogonal the axis of rotation.

6. The belay descender device according to claim 1, wherein the operating lever is mounted rotating around a second pivot-pin mounted on the cam.

7. A belay descender device for a rope comprising:

a flange defining a guide ramp;

a cam mounted rotating around a first pivot-pin fixed on the flange, the cam moving between a first position and a second position, the first position locking the rope when said rope is under tension;

an operating lever mounted rotating around a second pivot-pin directly fixed on the cam, the second pivot-pin being mounted rotating around the first pivot-pin, the operating lever being mounted movable with respect to the cam and to the flange, the operating lever being moveable in first and second opposite directions; and a drive rod directly fixed to the operating lever and arranged to slide along the guide ramp of the flange so that a rotation of the operating lever in the first direction causes sliding of the drive rod along the flange and causes movement of the cam from the first position to the second position with respect to the flange, wherein when the operating lever reaches a threshold position in a movement along the first direction, the drive rod loses contact with the flange and the cam moves to the first position, wherein the guide ramp is stationary with respect to the flange when the operating lever moves in the first direction.

8. The belay descender device according to claim 7, wherein the flange has first and second opposite main faces connected by a sidewall, the first main face defining a hole fixing the first pivot-pin, the sidewall of the flange defining the guide ramp.

9. The belay descender device according to claim 8, wherein the second pivot-pin defines an axis of rotation for the operating lever, the operating lever and the cam are separated by the flange and the second pivot-pin facing the guide ramp in a direction orthogonal the axis of rotation.

10. The belay descender device according to claim 7, wherein when the operating lever moves in the second direction, the drive rod pivots with respect to the operating lever.

11. The belay descender device according to claim 7, wherein the drive rod is mounted fixed to the operating lever when the operating lever move in the first direction.

12. A belay descender device for a rope comprising:

a fixed flange defining a guide ramp, the guide ramp being stationary with respect to the fixed flange;

a cam mounted rotating around a first pivot-pin fixed on the fixed flange, the cam moving between a first position and a second position, the first position locking the rope when said rope is under tension;

an operating lever mounted rotating around a second pivot-pin, the second pivot pin being directly mounted on the cam and mounted movable with respect to the cam and to the fixed flange, the second pivot-pin being mounted rotating around the first pivot-pin, the operating lever being moveable in first and second opposite directions; and a drive rod directly fixed to the operating lever and arranged to slide along the guide ramp so that a rotation of the operating lever in the first direction causes sliding of the drive rod along the fixed flange and causes movement of the cam from the first position to the second position with respect to the fixed flange, wherein when the operating lever reaches a threshold position in a movement along the first direction, the drive rod loses mechanical contact with the fixed flange and the cam moves to the first position, and wherein the drive rod is mounted rotating around a third pivot-pin mounted on the operating lever.

13. The belay descender device according to claim 12, wherein the second pivot-pin defines an axis of rotation for the operating lever, the operating lever and the cam are separated by the fixed flange and the second pivot-pin facing the guide ramp in a direction orthogonal the axis of rotation.

14. The belay descender device according to claim 12, wherein the drive rod is mounted rotating around the third pivot-pin directly mounted to the operating lever, the drive rod rotating with respect to the operating lever only when the operating lever moves in the second direction.

* * * * *